US005875638A

United States Patent [19]

Tinsler

[11] Patent Number: 5,875,638

[45] Date of Patent: Mar. 2, 1999

[54] REFRIGERANT RECOVERY SYSTEM

[75] Inventor: Theodore E. Tinsler, Sidney, Ohio

[73] Assignee: Copeland Corporation, Sidney, Ohio

[21] Appl. No.: 408,995

[22] Filed: Mar. 23, 1995

Related U.S. Application Data

[63] Continuation-in-part of Ser. No. 373,466, Jan. 17, 1995, Pat. No. 5,511,387, which is a continuation of Ser. No. 56,717, May 3, 1993, abandoned.

[51] Int. Cl.[6] ..... F25B 45/00

[52] U.S. Cl. ..... 62/149; 62/150; 62/292

[58] Field of Search ..... 62/77, 85, 292, 62/149, 231, 151, 150

[56] References Cited

U.S. PATENT DOCUMENTS

| | | | |
|---|---|---|---|
| 2,246,875 | 6/1941 | Carney . | |
| 4,249,387 | 2/1981 | Crowley . | |
| 4,476,688 | 10/1984 | Goddard . | |
| 4,539,817 | 9/1985 | Staggs et al. . | |
| 4,766,733 | 8/1988 | Scuderi . | |
| 4,776,174 | 10/1988 | Rich et al. . | |
| 4,805,416 | 2/1989 | Manz et al. . | |
| 4,809,515 | 3/1989 | Houwink . | |
| 4,862,699 | 9/1989 | Lounis | 62/149 |
| 4,903,499 | 2/1990 | Merritt . | |
| 4,981,020 | 1/1991 | Scuderi . | |
| 4,998,413 | 3/1991 | Sato et al. . | |
| 5,077,984 | 1/1992 | Vance . | |
| 5,090,211 | 2/1992 | Peters | 62/149 |
| 5,123,259 | 6/1992 | Morgan, Sr. . | |
| 5,127,232 | 7/1992 | Paige et al. . | |
| 5,181,390 | 1/1993 | Cavanaugh et al. | 62/292 |
| 5,182,918 | 2/1993 | Manz et al. | 62/149 |
| 5,189,881 | 3/1993 | Miles . | |
| 5,201,188 | 4/1993 | Sakuma . | |
| 5,203,177 | 4/1993 | Manz et al. | 62/149 |
| 5,233,840 | 8/1993 | Scaringe . | |
| 5,243,828 | 9/1993 | Paige et al. | 62/292 |
| 5,363,662 | 11/1994 | Todack | 62/292 |

FOREIGN PATENT DOCUMENTS

WO8100756 3/1981 WIPO .

*Primary Examiner*—John M. Sollecito
*Attorney, Agent, or Firm*—Harness, Dickey & Pierce, P.L.C.

[57] ABSTRACT

A refrigerant recovery system and method for recovering refrigerant from a separate refrigeration system are disclosed which first employs a liquid recovery phase and then a subsequent vapor recovery phase. A liquid sensor monitors the incoming recovered refrigerant and produces a signal indicative of when all of the liquid refrigerant has been recovered from the separate refrigeration system. The timer relay continues the liquid refrigerant recovery phase of operation for an additional predetermined time period once the signal is sensed. Thereafter, the recovery system switches to the vapor recovery phase of operation for yet an additional time period. The system then switches between these two phases until a predetermined condition occurs. An alternative refrigeration system is ambient temperature sensitive for controlling the recovery modes of operation. A thermistor is electronically connected to the timer relay which in turn produces a delayed signal that is indicative of the sensed ambient temperature. Based upon the sensed temperature, the timer relay sequences the system between the two different modes of recovery and adjusts the time periods for operating each mode.

23 Claims, 6 Drawing Sheets

REFRIGERANT RECOVERY SYSTEM

This is a continuation in part of U.S. patent application Ser. No. 08/373,466, filed Jan. 17, 1995 now U.S. Pat. No. 5,511,387, which is a continuation of U.S. Ser. No. 08/056,717 filed May 3, 1993, now abandoned.

FIELD OF THE INVENTION

The present invention relates generally to a method and apparatus for servicing a refrigeration system, more specifically, an improved refrigerant recovery system and method for recovering refrigerant from the refrigeration system being serviced.

BACKGROUND OF THE INVENTION

Refrigeration systems are widely used in commercial and domestic applications for a wide variety of purposes. Some of the most well known domestic applications of refrigeration systems include home air conditioners, refrigerators, food freezers, and automotive air conditioners. In commercial applications, refrigeration systems are commonly used for cooling various systems during manufacturing processes, for example, large walk-in coolers and the cooling of machinery that generates heat during the manufacturing process. The operation of these refrigeration systems is well known, and generally, refrigerants such as R-12; R-22, R-500 and R-502, are used as the cooling medium for the refrigeration process.

On occasion these refrigeration systems may require servicing due to the rigorous operating conditions the systems are subjected to. Most refrigeration systems, if not properly maintained, will become overly contaminated with acids, moisture, air, and/or liquid sludge. These contaminants are extremely harmful to the primary components of the refrigeration system, and, especially, the compressor may have its life drastically shortened. Also, when a refrigeration system operates with contaminated refrigerant, the efficiency of the system is jeopardized and, therefore, the cooling capacity of the system is less than optimal.

In the past, service technicians have not paid close attention to the release of refrigerants, for example, chloralfluorocarbons (CFC) and hydrochloralfluorocarbons (HCFC), into the atmosphere when servicing refrigeration systems. However, in 1992 the United States Congress mandated new provisions under the Federal Clean Air Act which made it illegal for anyone to vent CFCs and HCFCs into the atmosphere. Furthermore, new EPA Regulations require heating, ventilation and air conditioning technicians to begin to recover refrigerants when servicing refrigeration systems. Also, further EPA regulations require a minimum vacuum of ten inches of Mercury to be obtained in the field unit being recovered to assure that the field unit is sufficiently evacuated. There are at least two types of refrigerant recovery systems that have been used by service technicians when they are servicing a refrigeration system. In general, these systems are expensive because of their complicated design, they employ a multitude of components, they are inefficient in their recovery of refrigerants, they are limited as to the type of gases they can recover, they have an inherent tendency to contaminate the recovery compressor and therefore shorten the life of the compressor, and are not well suited for usage in the field by a service technician because of their size limitations.

The first type of refrigerant recovery system generally employed to recover refrigerant from a refrigeration system uses a positive displacement compressor that is vulnerable to damage because it directly pumps contaminated refrigerant, air, moisture and/or liquid sludge through the compressor to a storage device, nearly all, if not all, of the time during the refrigerant recovery process. Because these compressors continuously place the principal fluid in direct communication with the compressor's oil sump, valves, cylinders, etc., oil level and oil quality become difficult to maintain. As a result, the compressor may become corroded from the acids, air, moisture and other contaminants within the system. This obviously may lead to a shortened compressor life, for example, less than a year, and, also, adversely affect the performance of the refrigerant recovery system.

The second type of refrigerant recovery system utilizes a closed refrigeration system such as that described in U.S. Pat. No. 4,539,817. In this type of refrigerant recovery system, a closed refrigeration system is provided separate from the field unit being serviced. The field unit could be, for example, a walk in freezer that could be used in a restaurant or an air conditioner unit that could be found in a residential home. The closed refrigeration system includes a condenser, compressor, a series of filters and valves, and a storage container having heat exchange coils located therein. The heat exchange coils located within the container are cooled to create a low pressure atmosphere within the container which is directly connected to the fluid refrigeration system to be serviced. This pressure differential between the field unit and the storage container allows refrigerant to be naturally drawn into the container. The container is capable of being disconnected from the closed refrigeration system through the use of a series of couplings. A new container can be hooked up to the closed refrigeration system and the cycle can be repeated. Because the closed refrigerant recovery system utilizes a storage container that employs evaporator coils located therein, the cost of each container becomes very expensive. Also, the coils increase the weight of the container and therefore decrease its mobility. Furthermore, because this system operates solely on the premise of a pressure differential created by the cooling effect of the heat exchange coils, the volume of recovered refrigerant is less than optimal because the system is incapable of reaching sufficiently low pressures within the container. The result is that a measurable quantity of refrigerant is stranded in the field unit when it is serviced. This quantity of refrigerant is sometimes dispersed into the atmosphere when the unit is being serviced, and therefore, it is not recovered and thus not recycled. And finally, because the container uses a series of couplings for interconnecting the storage containers, the opportunity for releasing refrigerant into the atmosphere is increased.

In light of the above-mentioned problems, it would be desirable to have a refrigerant recovery system that is portable, utilizes a refrigeration design that minimizes the components that are subjected to contaminated refrigerant, air and moisture, while being capable of removing 100% or nearly 100% of the refrigerant from the field unit being serviced. Such a system should minimize, if not entirely eliminate, the quantity of refrigerant dispersed into the atmosphere for environmental concerns and so that the maximum amount of refrigerant can be recycled. Also, such systems should be capable of creating sufficiently low vacuum pressures in the field unit in order to enhance the fluid recovery rate and recoverable fluid volume. Furthermore, it would be desirable if the recovery system could be universal so that various fluids could be recovered by a single recovery system. It would also be desirable to provide a refrigerant recovery system that is inexpensive, portable and lightweight in order to accommodate the needs of the field service technician.

SUMMARY OF THE INVENTION

Accordingly, it is an object of the present invention to provide a refrigerant recovery system that overcomes the problems mentioned above. Such a refrigerant recovery system should protect the compressor of the refrigerant recovery system when transferring contaminated refrigerant from the field unit.

A first preferred form of the invention provides as one of its aspects, a novel closed refrigerant recovery system for recovering refrigerant from a field unit. The closed refrigerant recovery system comprises a storage structure capable of being evacuated and receiving refrigerant that is recovered from the field unit. A unique evaporator is provided that has coils surrounding the storage structure and said evaporator is operable to receive the storage structure and maintain the storage structure at a predetermined temperature while contaminated refrigerant is recovered from the field unit. The closed refrigerant recovery system further comprises a condensing device for condensing the refrigerant located in the closed refrigerant recovery system, a vacuum pump connected to the storage structure for reducing the pressure within the storage structure, at least one flow sensor structure operable to sensor the flow of contaminated refrigerant into the storage structure, and a recovery compressor for compressing the refrigerant located within the closed loops of the recovery system, whereby the closed refrigerant recovery system is operable to contain the recovered contaminated refrigerant from the recovery compressor and the vacuum pump. The refrigerant recovery system further includes an optional transportation structure that is capable of transporting the refrigerant recovery system in the field.

The first preferred form of the present invention provides as another of its aspects, a process for recovering refrigerant from a separate refrigeration system, for example a field unit such as an air conditioner. The process comprises locating a removable refrigerant storage tank within the evaporator of the refrigeration recovery system, cooling the storage tank to below a predetermined temperature, and evacuating the storage tank to a predetermined low pressure to create a pressure differential between the field unit and the storage tank. The process further comprises opening valves and introducing contaminated refrigerant from the field unit to the storage tank while maintaining the temperature within the storage tank at a predetermined level until nearly all of the refrigerant is recovered.

Because of this novel design, none of the contaminated fluids recovered by the recovery system are ever placed in contact with the recovering compressor and, therefore, the life of the compressor is substantially increased. Furthermore, by providing a novel removable and reusable refrigerant storage tank capable of being stored and cooled by the unique evaporator, various types of fluids can be collected by the closed refrigerant recovery system. Also, because the novel refrigerant recovery system utilizes few connections between the field unit and the recovery system itself, very little, if any, refrigerant is lost to the atmosphere during the reclaiming process. Moreover, by creating a significant temperature and pressure differential between the storage tank and the field unit, nearly all of the contaminated refrigerant can be reclaimed. Also, there is increased storage per tank because the process condenses refrigerant in the tank via cooling. And finally, a booster pump may be provided in-line between the storage tank and the field unit in order to remove any residual refrigerant remaining in the field unit by evacuating to a lower pressure.

A second preferred form of the present invention provides as one of its aspects, a novel refrigerant recovery system for recovering refrigerant from a field unit. This refrigerant recovery system comprises a compressor, a condenser, an expansion device, solenoid valves, check valves and a portable refrigerant recovery tank that is insertable within a thermal insulation device.

The second preferred form of the present invention provides as another of its aspects, a process for recovering refrigerant from a separate refrigeration system. The process comprises the utilization of two phases, of which, the first phase includes the steps of connecting the field unit being recovered to a recovery tank, locating the removable recovery tank within a thermal insulation device and operating the cooling cycle of the recovery unit such that the removable recovery tank becomes cooled thereby causing the pressure within the recovery tank to decrease and the refrigerant in the field unit to flow into the recovery tank. When the pressure within the recovery tank is below a predetermined value and substantially all of the liquid refrigerant has been recovered, the second phase is activated thus allowing recovered refrigerant to be routed directly through the compressor and into the cooled low pressure storage tank. The operation of the second phase allows substantially all of the refrigerant in the field unit to be evacuated in a relatively short period of time because vacuums less than 20 inches mercury are reached within the field unit. And for increased performance, the system can be operated to modulate between phases one and two in order to keep the recovery tank at a low pressure and temperature. An alternative to this second preferred form provides a unique sensor operable to sense when no liquid refrigerant is being recovered during phase one.

Yet another third preferred form of the present invention incorporates the above-mentioned second preferred form and its alternative. That is, during phase one operation of refrigerant recovery, a fluid sensor monitors the presence of liquid refrigerant in the recovered refrigerant. Once liquid refrigerant is no longer sensed, a timer allows the phase one recovery mode to continue for an additional 90 seconds. Thereafter, a phase two, or vapor recovery mode, is initiated whereby gaseous refrigerant is drawn through the compressor and directed to the storage tank. The second phase of operation continues for an additional 90 seconds. The recovery system may switch between phases one and two until either recovery is complete, a float switch senses a storage tank full condition, or a predetermined pressure is sensed in the system.

A fourth form of the present invention incorporates a thermistor that senses the ambient temperature when the refrigerant recovery system is operating. The thermistor produces a signal which is electrically connected to a circuit that computes the time period in which the timer should delay the operation of phases one and two. Thus the previously discussed fixed 90 second time period will be adjusted in order to accommodate the ambient conditions in which the refrigerant recovery system is operating. For example, during high ambient conditions, the phase one mode of operation will be extended. However, if lower ambient conditions are present, then a time period of perhaps less than 90 seconds will be produced by the timer. Thus, the refrigerant recovery system is ambient temperature sensitive which allows it to optimize the time period for operation of phases one and two. This enhances the overall system performance.

From the following specification taken in conjunction with the accompanying drawings and appended claims, other objects, features and advantages of the present invention will become apparent to those skilled in the art.

BRIEF DESCRIPTION OF THE DRAWINGS

FIG. 8 is an electronic circuit diagram that is used in conjunction with the hardware illustrated in the FIG. 7 embodiment.

DETAILED DESCRIPTION OF THE PREFERRED EMBODIMENT

The refrigerant recovery system is designed to protect the compressor of the recovery system from being contaminated by recovered refrigerant (or other fluids) including any potentially damaging contaminants carried thereby including other liquids, gases, etc. (hereinafter fluids), as well as being designed to maximize the fluid recovery rate and the quantity of refrigerant recoverable from the field unit. However, it is to be understood that the following detailed description of the preferred and alternative embodiments are merely exemplary in nature and is in no way intended to limit the invention, its application or uses.

Figure 1:
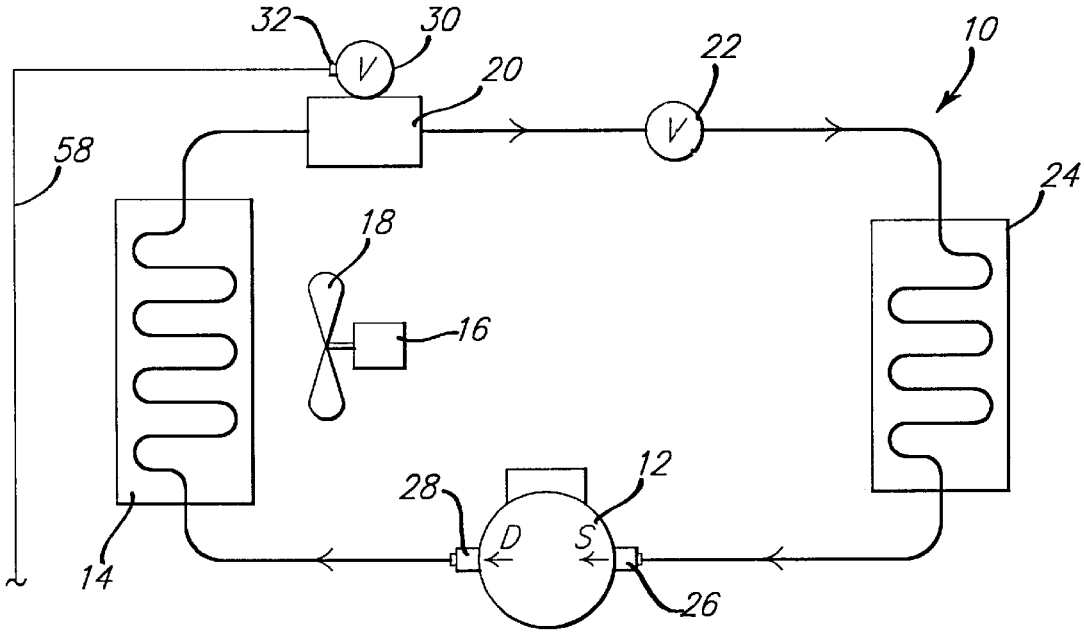
FIG. 1 is a schematic diagram of a typical air conditioning system that can be serviced by the present invention.

With particular reference to FIG. 1, the basic components of a standard refrigeration or air conditioning system that uses refrigerant for a cooling means is illustrated. This air conditioning system, hereinafter referred to as a field unit 10, includes a standard compressor 12 which compresses the refrigerant gas and delivers the gas to a condenser 14 where the gas is subsequently converted to a liquid state. A motor 16 may be provided to propel a fan 18 for cooling the condenser 14 to enhance reliquification of the refrigerant or, alternatively, some other heat exchange means may be utilized for this purpose. The liquid refrigerant flows from the condenser 14 to a refrigerant containing unit 20 that acts as a small reservoir for storing and containing the liquid refrigerant during the operation of the field unit. The storage containing unit 20 can also include a display member (not shown) such as a sight glass to allow the operator to view the refrigerant. From the storage containing unit 20 the liquid refrigerant is delivered to an evaporator 24 via an expansion valve 22 where the refrigerant is evaporated to a gaseous state to enable the system to provide cooling. Once the refrigerant has been returned to a gaseous state, refrigerant then flows to the suction inlet port 26 of the compressor 12 where the refrigerant is compressed and discharged through discharge port 28 and then delivered to the condenser 14. This cycle is repeated until the field unit supplies the desired amount of cooling. The field unit 10 also has a standard on-off sensor valve 30 which communicates with the refrigerant containing unit 20. Valve 30 is maintained in a closed position during operation of the field unit 10 and is primarily used when a service technician wishes to drain the refrigerant from the field unit 10. A conventional connector coupling 32 is provided and allows conduit 58 of the recovery system 40 to be easily disconnected from the field unit 10.

Figure 2:
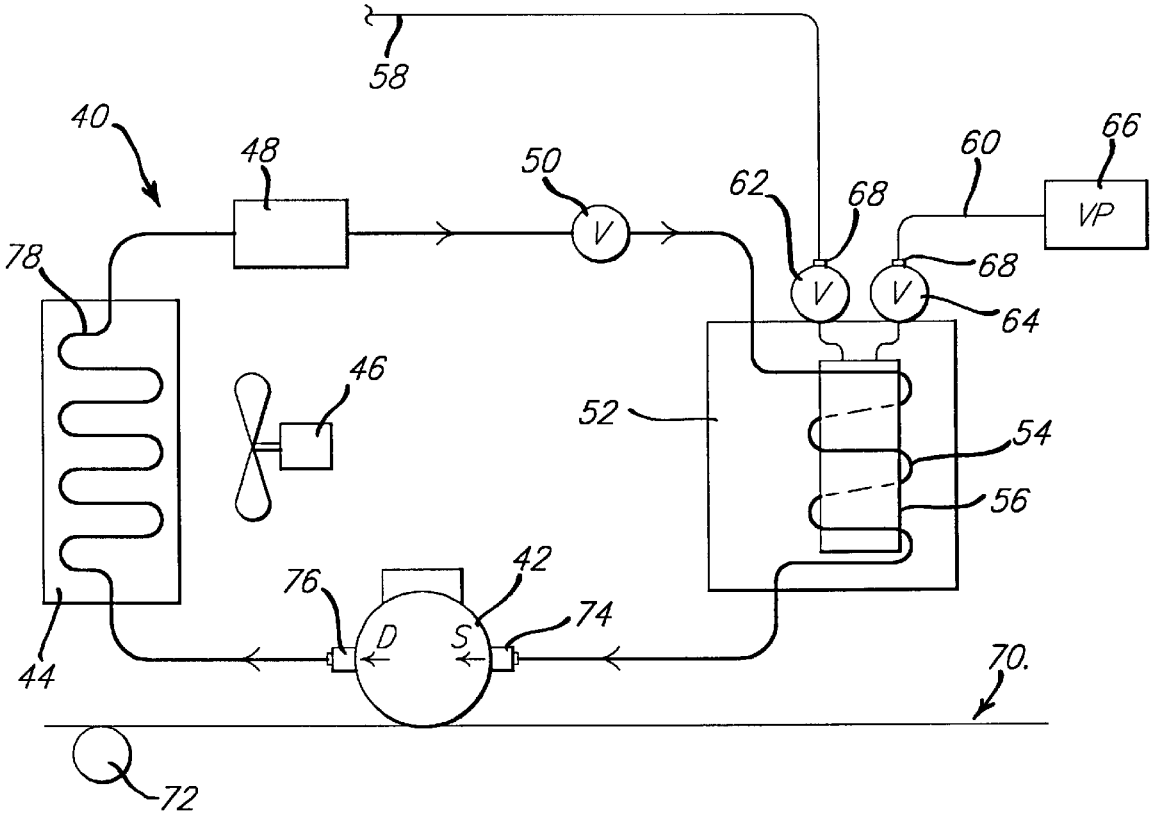
FIG. 2 is a schematic diagram of the closed-loop refrigerant recovery system of the present preferred invention showing the primary components of the system.

The first preferred form of the novel refrigerant recovery system 40 is illustrated in FIG. 2. The primary components of the refrigerant recovery system 40 includes a conventional compressor 42 connected via a conduit to a standard condenser 44 that is cooled by a fan unit 46. The condenser 44 is connected via a conduit to an optional fluid storage tank 48 that supplies fluid to a conventional expansion device 50. The expansion device 50 provides expanded liquid to a unique evaporator housing 52 whereby evaporator coils 54 are wrapped around a unique portable refrigerant storage tank 56. Fluid conduit lines 58 and 60 are releasably connected to the portable refrigerant storage tank 56 and have sensor valves 62 and 64 in-line with said conduits. The sensor valves 62 and 64 may either be manually controlled or of the solenoid-type actuated valves. A conventional vacuum pump 66 is provided on one end of conduit 60 and is releasably connected to valve 64 by a quick disconnect means 68. Likewise, conduit 58 is connected to sensor valve 62 by a connector means 68. An optional transporting structure 70 is illustrated and may include wheels 72 that allow the above-mentioned components of the refrigerant recovery system 40 to be easily transported in the field by a service technician. The refrigerant recovery system 40 can therefore be portable and is intended to be lightweight. The present recovery system weighs approximately 50 pounds. It will be appreciated by those skilled in the art that assembly of the refrigerant recovery system to the transport structure 70 is conventional in nature and needs no further discussion.

The refrigeration storage tank 56 is a pressure vessel capable of being subjected to pressure conditions normally found in refrigeration systems. Furthermore, the refrigerant storage tank 56 is portable, easily replaceable and insertable within the evaporator housing 52 and therefore, can be replaced when it is full of contaminated refrigerant, or other fluids, with another storage tank or the like, and is preferred to have a fifty pound capacity. Because the storage tank 56 is interchangeable, the refrigeration recovery system 40 can be used to recover fluids other than those refrigerants that are generally found in refrigeration systems. The evaporator housing 52 is unique in design and includes evaporator coils 54 which preferably substantially surrounds the storage tank 56 to enhance the cooling rate of the storage tank 56. By surrounding the storage tank 56 with coils 54, the tank 56 can be cooled at a much faster rate which increases the fluid recovery rate and thus cuts down on the time a service technician is on the job. The expansion device 50 is a standard expansion valve and delivers a predetermined quantity of cooled liquid refrigerant to coils 54 whereby the refrigerant gas absorbs heat from the storage tank 56 and the heated refrigerant is vaporized by the time it exits the evaporator housing 52. The refrigeration recovery system 40 has sufficient cooling capacity to cool the refrigeration storage tank 56 and maintain a temperature at or below zero degrees Fahrenheit (preferably Zero to −60 degrees Fahrenheit) during the entire time period fluids are evacuated from the field unit 10. As a consequence, a vacuum in the pressure range of 10 inches of Mercury is obtainable within the storage tank 56. At a storage tank inside temperature of zero degrees Fahrenheit or lower, the tank saturated pressure is at or below the normal suction pressure on a conventional open recovery system. These low temperatures are required during the recovery process in order to lower the saturated pressure within the storage tank 56 to below atmospheric pressure.

It will be appreciated that the evaporator housing 52 could further include a hinged door (not shown) that may allow the storage tank 56 to be substantially enclosed within the evaporator housing 52. If such an embodiment is employed, a suitable access for operating valves 62 and 64 should be provided. The evaporator housing 52 may further include and/or act as an insulator for storage tank 56 to help maintain storage tank 56 at a predetermined temperature during the recovery process. It will further be appreciated that any conventional quick release couplings could be employed to easily disconnect the storage tank 56 from any hoses or conduits connected to it.

The vacuum pump 66 is a standard vacuum pump and removes the air within the storage tank 56 so that the migration process of refrigerant into the storage tank 56 is greatly enhanced. The vacuum pump 66 is removably coupled, via a conduit 60, to flow sensor valve 64 which is preferably provided on the storage tank 56. Usage of the pump 66 is normally only required when a fresh or new storage tank 56 is used where the tank 56 is often empty of fluids and thus, is full of air that needs to be evacuated.

The compressor 42 is a hermetically sealed compressor of conventional design and may be of the rotary, scroll, or piston type compressor. The compressor 42 has a suction port 74 and discharge port 76 and is capable of providing a sufficient quantity of compressed refrigerant to allow the storage tank 56 to be cooled during the reclaiming process.

The condenser 44 is a standard air cooled condenser having heat exchange coils 78 routed therein which are cooled by the air circulated by circulating fan 46. The condenser 44 has a sufficient cooling capacity to cool the compressed gas that enters the condenser 44 and thereby converting the compressed gas into a liquid state before exiting the condenser 44. Water-cooled type condenser units may be employed, however, such units tend to increase the weight of the condenser and, therefore, make the refrigerant recovery system less portable.

A discussion of the operation of the first preferred embodiment as disclosed in FIG. 2 will now follow. For example purposes only, a discussion of removing refrigerant from an air conditioner is presented.

When a field unit 10 requires servicing that necessitates that the contaminated refrigerant be removed from the field unit 10, the service technician must carefully remove the contaminated refrigerant from the field unit 10 without dispersing any refrigerant into the atmosphere. To accomplish this task, the field technician must properly install a portable storage tank 56 within the evaporator housing 52 of the refrigerant recovery system 40 and connect vacuum pump 66 to valve 64. Next, the service technician must locate the refrigerant recovery system 40 in close proximity to the field unit 10 so that the conduit 58 may be connected by couplings 32 and 68. Once this is done, the field unit 10 is turned off, valves 30, 62 and 64 are placed in a closed position, and the compressor 42 of the refrigerant recovery system 40 is then activated to begin the cooling cycle which chills the storage tank 56. Once the storage tank 56 has been cooled to a desired inside temperature, for example Zero degrees to −60 degrees Fahrenheit, valves 62 and 64 are then opened and vacuum pump 66 is activated. Note, however, that the vacuum pump 66 need only be used when non-condensables (gases) are in the tank 56. This primarily occurs when a new storage tank 56 is used. The compressor 42 may continue to run or be deactivated during the evacuation step; the key here is to maintain the desired temperature within the storage tank 56. Also, throughout the recovery process, the compressor 42 may be activated and deactivated at various times to assure proper cooling of the storage tank 56. The vacuum pump 66 is operated for a sufficient period of time to reduce the pressure within storage tank 56 and conduit 58 to a low pressure normally encountered in refrigeration equipment. It is preferred that the pressure be reduced to 200 microns of Mercury or lower to remove as much non-condensable gas as possible in the tank 56 in order to enhance the fluid recovery rate. Once the predetermined pressure level is attained, the vacuum pump 66 is shut off and valve 64 is closed. As long as valve 64 remains closed, no contaminated refrigerant will contact the vacuum pump 66 and, therefore, the integrity of the pump 66 will be maintained. It will be appreciated that the compressor 42 and vacuum pump 66 may be turned on in any order so that the desired effect is obtained. The key here is to assure that tank 56 becomes evacuated prior to starting the fluid recovery process and that the compressor 42 and the vacuum pump 66 will not be contaminated with recovered fluids.

At this point, recovery of the contaminated refrigerant from the field unit 10 can begin by opening valves 30 and 62. Once valve 30 is opened, the contaminated refrigerant (both liquids and gases) within field unit 10, and especially the contaminated refrigerant within storage containing unit 20, can be drawn through conduit 58, valve 62 and directly into the storage tank 56. Because of the way the fluid is routed in this system, it is not necessary to be concerned about recovered fluids contaminating the recovery system 40 and causing damage as may happen in other well-known units. While recovery is occurring, compressor 42 may continue to operate, if needed, in order to maintain the storage tank 56 at a desirable inside temperature. If the recovered contaminated refrigerant is in a gaseous state it will be partially, if not entirely, liquified because it will be cooled when transferred into the cooled storage tank 56. Because of this change in state, a greater amount of refrigerant can be stored in the storage tank 56. Also, because of the temperature and pressure differential between the storage containing unit 20 and storage tank 56, substantially all of the refrigerant stored in the storage containing unit 20 and in the remaining circuitry of the field unit 10 is transferred into the portable storage tank 56. Once transfer of the fluid is satisfactorily completed, valves 30 and 62 are closed and the compressor 42 is shut down if it has not yet already done so. If, for instance, the storage tank 56 becomes full prior to all of the contaminated refrigerant being removed from the field unit 10, the valves 30, 62 and 64 should be closed, the lines 58 and 60 should be disconnected, another portable storage tank 56 should be inserted within the evaporator housing 52, the lines 58 and 60 should be reconnected and the tank 56 can be cooled and evacuated by the method disclosed above. The valve 64 should then be closed and valves 30 and 62 should be opened and the remaining contaminated refrigerant may be recovered. At this time, the storage tank 56 should have a quantity of contaminated fluid within it that can later be recycled by a separate process. If the field technician desires to recover a different fluid, a separate storage tank 56 can be inserted within the evaporator housing 52 and the same process of recovering refrigerant as previously described can be conducted for this different fluid. If the same type of fluid is to be recovered, the same tank 56 can be used until it is full. It will be appreciated that depending upon the type of fluid being recovered, and the desired recovery rate, that the storage tank 56 can be cooled at various rates in order to obtain desirable effects.

Figure 3:
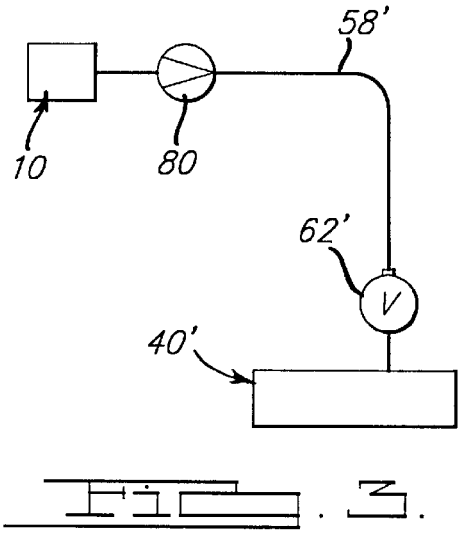
FIG. 3 is an alternative embodiment to the first preferred form of the invention where a booster pump is employed.

FIG. 3 illustrates an alternative refrigerant recovery system 40' whereby an optional booster pump 80 is located in line 58' just prior to flow sensor valve 62'. Other than this slight change, the remaining components of refrigerant recovery system 40' are the same as those components found in the previously discussed recovery system 40. The primary purpose of the booster pump 80 is for enhancing the recovery of refrigerant from the field unit 10. The booster pump 80 is of conventional design and shall be operable to pump a wide variety of fluids and can be manually activated or deactivated. Usage of the booster pump 80 allows vacuums in the range of 20 to 25 inches of Mercury to be obtained in the field unit 10, therefore, substantially all, if not all, of the fluid in the field unit 10 is recovered into storage tank 56.

The optional booster pump 80 may be activated at any time during the above-described recovery process to enhance the recovery of fluid from the field unit 10. It is preferred, however, that the pump 80 be activated later in the recovery process where primarily only gasses remain in the field unit 10. This will enhance the life of the pump 80 because contaminated liquids won't be present to contaminate the pump 80. The pump 80 may be activated and deactivated, manually or automatically, according to any desired operating condition.

Figure 4:
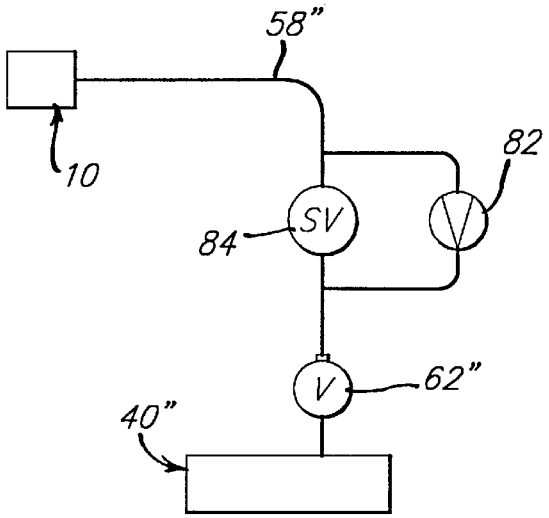
FIG. 4 is an alternative embodiment to the FIG. 3 invention where a booster pump and solenoid valve are employed.

An alternative to the FIG. 3 set up is illustrated in FIG. 4 where a booster pump 82 is provided and a solenoid valve 84 is located in-line with conduit 58" just before valve 62". The remaining components of the recovery system 40" are the same as those components found in the previously discussed recovery system 40.

During the initial recovery of fluids from the field unit 10, the booster pump 82 would be turned off and the solenoid valve 84 would be opened to allow free flow of fluids therethrough. At any time during the recovery process, the booster pump 82 may be turned on, however, it is preferred that it be employed only when nearly all of the fluid has been removed from the field unit 10. When this stage occurs, the solenoid valve 84 is closed and the booster pump 82 is activated to thereby enhance the removal of the remaining fluids in the field unit 10. This set up assures removal of all refrigerant from the field unit 10; at which time the pump 82 will be deactivated. The booster pumps 80 and 82 may be cycled on and off according to the desired effect.

Figure 5:
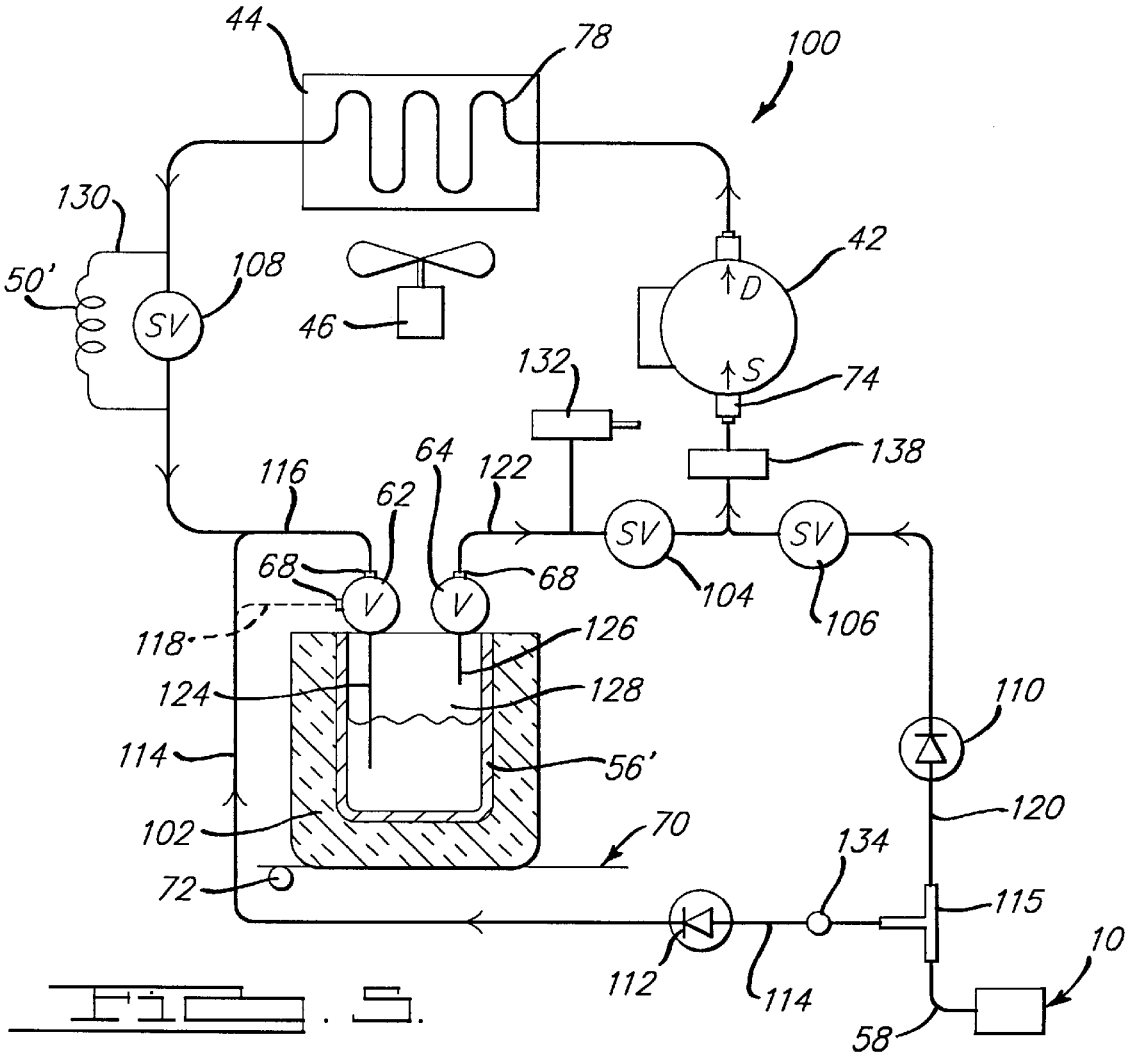
FIG. 5 is a schematic diagram of an alternative refrigerant recovery system showing the primary components of the system.

FIG. 5 illustrates an alternative refrigerant recovery system 100 that utilizes two separate phases of operation for recovering contaminated refrigerant from a field unit 10. The first phase is used primarily to remove the liquid refrigerant and some gases from the field unit 10 while the second phase is activated for only a short period of the recovery cycle whereby primarily contaminated gaseous fluids are recovered from the field unit 10. Where possible, like numbers are used to indicate elements previously discussed herein. The primary components of this novel refrigerant recovery system 100 includes a standard compressor 42, a standard condenser 44, a fan 46 for cooling the coils 78 of the condenser 44, a portable refrigerant recovery tank 56' that acts as a cold evaporator, a thermal insulation device 102 and a field unit 10 as previously described herein. The thermal insulation device 102 is provided for retaining and maintaining coolness of the recovery tank 56 and may be made of any thermal insulating type material such as styrofoam and may have an easily removable lid for encapsulating the recovery tank 56. Solenoid valves 104, 106, and 108 are provided in-line as well as check valves 110 and 112 for controlling the flow of refrigerant within the system 100. It will be appreciated that the solenoid valves could be replaced with manually operated valves, however, solenoid valves are preferred. Standard hand controlled fluid flow valves 62 and 64 are provided and may be connected to the recovery tank 56' for controlling the flow of fluid into and out of the tank 56'. Quick disconnect connectors 68 are provided on the valves for quick removal of the storage tank 56' from the system 100. The check valve 112 is located in conduit 114 that connects the field unit 10 via conduit 58 and Tee 115 to a return conduit 116. An alternative to this arrangement provides an alternative conduit 118 that connects to conduit 114 and dumps recovered fluids into valve 62 and into the bottom of recovery tank 56. The check valve 110 and solenoid valve 106 are located in a fluid conduit 120 that connects the field unit 10 via conduit 58 and Tee 115 to the compressor 42. The solenoid valve 104 is located in a fluid conduit 122 that connects with the valve 64 and the compressor 42. The remaining solenoid valve 108 is in return line 116 that is connected to valve 62 where a line 124 dumps refrigerant into the bottom of storage tank 56'. It is important to locate a suction conduit 126 within the tank 56' such that the end of conduit 126 is at a position above the liquid refrigerant within the storage tank so that only gases 128 are sucked out of the storage tank 56'. The conduits 124 and 126 may be attached to the storage tank 56' or the valves 62 and 64 in any conventional manner.

Other components of the recovery system 100 include an expansion device 50', preferably a capillary tube, which is provided in a circuit 130 that is routed around the solenoid valve 108. A conventional pressure switch 132 is in series with the return conduit 122 for sensing the pressure in the recovery tank 56'. This pressure switch 132 assists in the activation and deactivation of phases 1 and 2 which will be discussed later in greater detail.

A sight glass 134 is in series with conduit 114 and allows the operator to view the flow of fluids through lines 114 during phase one. And finally, a standard filter dryer 138 is preferably located at the suction side of the compressor 42 to remove contaminants such as acids from the recovered refrigerant. It will be appreciated that the filter dryer 138 could be located at other locations, for example, in line 114 before the sight glass 134 or in line 58. The delivery line or conduit 114 directs fluid during the phase one operation from the field unit 10 and into the return line 116. The second delivery line 120 directs fluid during the phase two operation from the field unit 10 to the compressor 42. The T-coupling 115 may have quick-disconnects 68 (not shown) and is used to join conduits 114 and 120 together to conduit/line 58. The conduit 58 may be a flexible ⅜ inch inside diameter hose, or the like. And finally, an optional transport structure 70 may be provided with wheels 72 in order to make the system 100 portable.

The operation of the refrigerant recovery system 100, as schematically illustrated in FIG. 5, will now be discussed. The first phase of operation may begin once the field unit 10 and recovery system 100 are properly connected. During the phase one operation, solenoid valves 106 and 1 08 are closed and solenoid valve 104 and hand valves 62 and 64 are opened. Once the compressor 42 is activated, reclaimed gas and liquid refrigerant (reclaimed fluid) is drawn from field unit 10 through conduit 58, check valve 112 and through line 114 where it is dumped into the return line 116 to combine with the cooled liquid refrigerant of system 100 before being passed through valve 62 and line 124 where it is then dumped into the bottom of recovery tank 56'. The refrigerant gas 128 is then sucked out of the refrigerant recovery tank 56' through the strategically located end of the conduit 126, through the hand valve 64, the line 122 to the solenoid valve 104 and through the filter dryer 138 and then back through the compressor 42 whereby the gas is condensed in the condenser 44, transmitted through the circuit 130 to the expansion device 50', through the conduit 116 where it is combined with reclaimed fluid from the conduit 114 and then dumped back into the recovery tank 56' via the conduit 124. The dumping of the reclaimed fluid into the conduit 116 tends to pre-cool the reclaimed fluid prior to being dumped into the tank 56'. If the alternative conduit 118 is employed, then the process above would be the same except that the reclaimed fluid would be directed specifically into the valve 62 and then into the conduit 124 and thus not be pre-cooled just prior to being dumped into the tank 56'. During phase one, the operator will monitor sight glass 134 to determine when all of the liquid refrigerant is removed from the field unit 10. The clearing of the sight glass 134 indicates that all of the easily removable liquid refrigerant has been completely removed from field unit 10; at which time the operator will flip a manual switch (not shown) to an automatic phase. During this automatic phase the pressure switch 132 continues to sense the fluid pressure within conduit 122 and will preferably activate phase two once the pressure within the recover tank 56' reaches 40 PSIG. If the pressure within recovery tank 56' is 40 PSIG or less once the manual switch is flipped to the automatic phase, then the pressure switch 132 will automatically activate the phase two operation. This portion of phase one can be automated through the use of a liquid sensor 136 that automatically senses the presence of liquid refrigerant in line 114. The discussion of sensor 136 is set out in greater detail in the discussion of the FIG. 6 embodiment. It will be appreciated that the pressure switch 132 can be set to activate phase one at other pressure levels, however, 40 PSIG is presently preferred.

The life of the compressor 42 is enhanced because of cooled refrigerant gas being passed through it during phase one and also because no liquid refrigerant is passed through it during the phase one operation. As an efficiency and safety measure, refrigerant is prevented from returning to the field unit 10 by the positioning the of check valves 110 and 112. Under normal operating conditions, phase one is expected to take approximately four minutes to complete whereby approximately eleven pounds of R-502 refrigerant is recovered which should be all of the liquid refrigerant in the field unit 10. It will be appreciated that the rate of recovery and other performance characteristics will vary depending upon the type of refrigerant being recovered, the size of the field unit 10, and other factors.

The system 100 is designed such that little or no refrigerant needs to be in the storage tank 56' when phase one is activated in order for the reclaiming process to work. However, the process of reclaiming fluids from the field unit 10 would be enhanced if at least a small amount of refrigerant is present in the storage tank 56' by which the cooling process may be initiated because the system 100 has no significant volumes of refrigerant available other than that located in the lines and the various components of the system 100. It should be noted that as the refrigerant available to compressor 42 increases due to the addition of the recovered refrigerant, the cooling capacity of the system will also increase thus creating a snowballing effect promoting the recovery process.

During phase two of the refrigerant recovery process, the solenoid valve 104 is closed and the solenoid valves 106 and 108 are opened. The hand valves 62 and 64 remain open during this phase also. The compressor 42 will remain in operation during the phase two operation. Once phase two is activated, reclaimed fluid, primarily in gaseous form, is sucked out of field unit 10, passed through the conduit 120, the check valve 110, the solenoid valve 106 and through the dryer 138 to the suction side 74 of the compressor 42 whereby the fluid then passes through the valve 108 and into the storage tank 56' via conduit 116. Phase two operates faster than phase one and may take approximately two minutes to reach a vacuum of 20 inches of Mercury, or less, within the field unit 10 which results in substantially all of the refrigerant being recovered from the field unit 10. Together, phases 1 and 2 take approximately eight minutes to perform whereby approximately twelve and one-half pounds of R-502 refrigerant may be reclaimed. This offers a substantial improvement in fluid recovery performance over other well-known systems.

Temperature sensors, not shown, may be provided in the system 100 to assure that the compressor 42 does not overheat during the phase one and/or phase two operations. The refrigerant recovery system 100 may also be made operable to modulate between phases 1 and phases 2 in order to satisfy any desirable operations. For example, to prevent the storage tank 56' or the compressor 42 from overheating, it would be desirable to cool them down and this can be done by reactivating phase one for a certain period of time.

And finally, it is possible that a service technician could hook up conduit 58 directly to either a gas outlet port or a liquid outlet port (not shown) that may be provided on the field unit 10. This would allow gases or liquids to be recovered individually from the field unit 10 to a storage tank that is set up for either gases or liquids.

Figure 6:
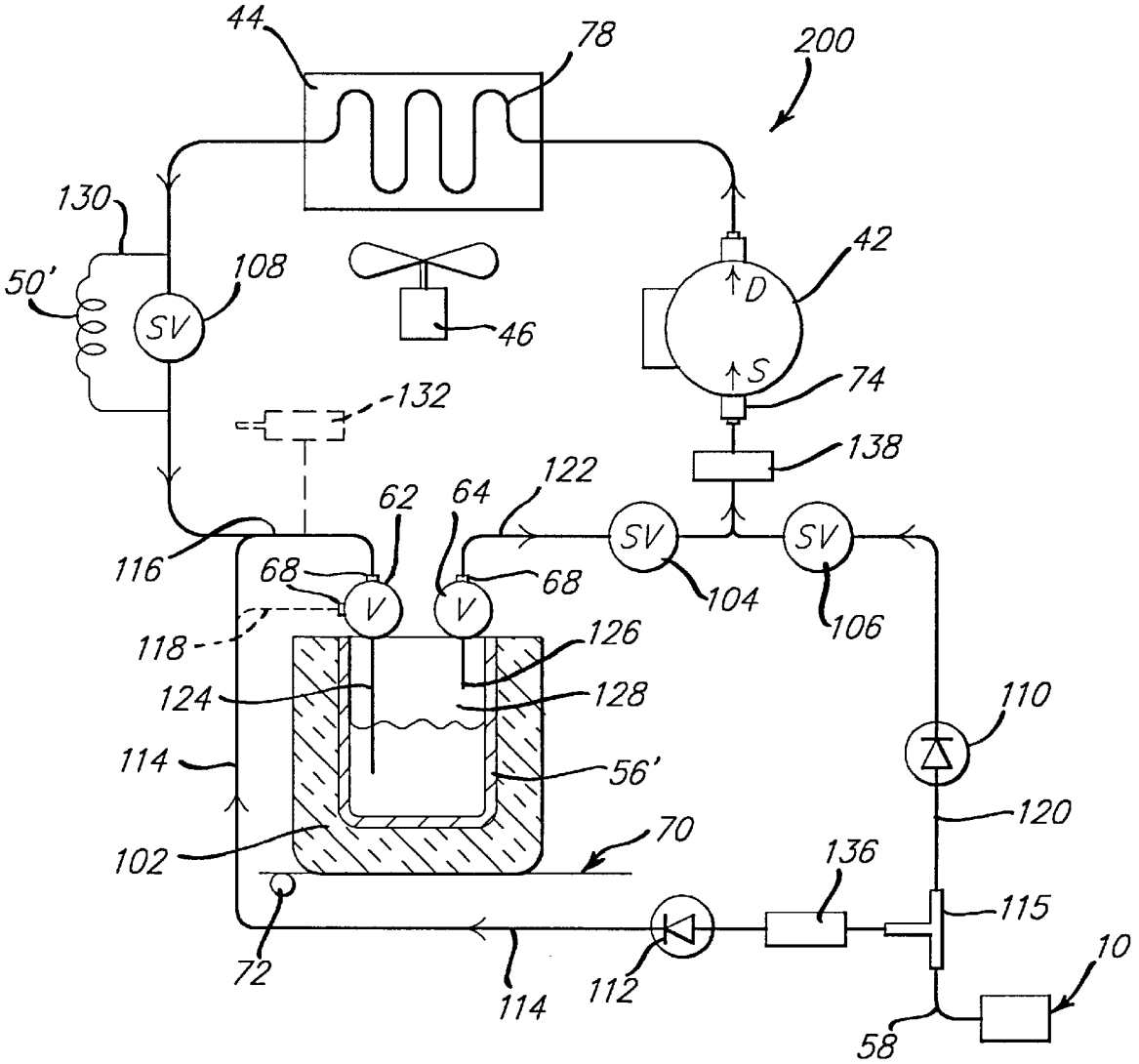
FIG. 6 is an alternative to the FIG. 5 embodiment where a fluid sensor is employed in the recovery system.

FIG. 6 illustrates an alternative embodiment 200 to the FIG. 5 refrigerant recovery system 100. The refrigerant recovery system 200 includes essentially the same components of the FIG. 5 embodiment and, where applicable, the same reference numerals are used. The primary modification to this embodiment includes the change in the fluid and electrical circuitry whereby an automatic liquid sensor 136 is located in line 114 to sense the presence, and/or lack thereof, of liquid refrigerant that is being recovered from field unit 10. The usage of this liquid sensor 136 allows the refrigerant recovery system 200 to be entirely automated which minimizes the possibility for operator errors and maximizes fluid recovery. The fluid sensor 136 replaces the sight glass 134 which previously required an operator to flip a manual electronic switch which then allowed pressure switch 132 to sense the pressure of the fluid in tank 56' and to activate the phase two once approximately 40 PSIG was attained within storage tank 56'. Here, the liquid sensor 136 automatically senses the lack of fluid in line 114 and produces a signal that allows pressure switch 132 to activate phase one once the predetermined pressure is attained within storage tank 56'. Usage of this sensor 136 allows the field technician to perform other services while the refrigerant is automatically being recovered from the field unit 10, as well as eliminates any judgment call by the operator as to whether all of the liquid refrigerant has been recovered from the field unit 10. This of course increases the efficiency of the refrigerant recovery system 200.

A further modification to the FIG. 6 embodiment is illustrated by the locating of the pressure switch 132 in line 116. However, it will be appreciated that the pressure switch can be located at various places throughout the recovery system 200 and, is preferably located in conduit 122.

Figure 7:
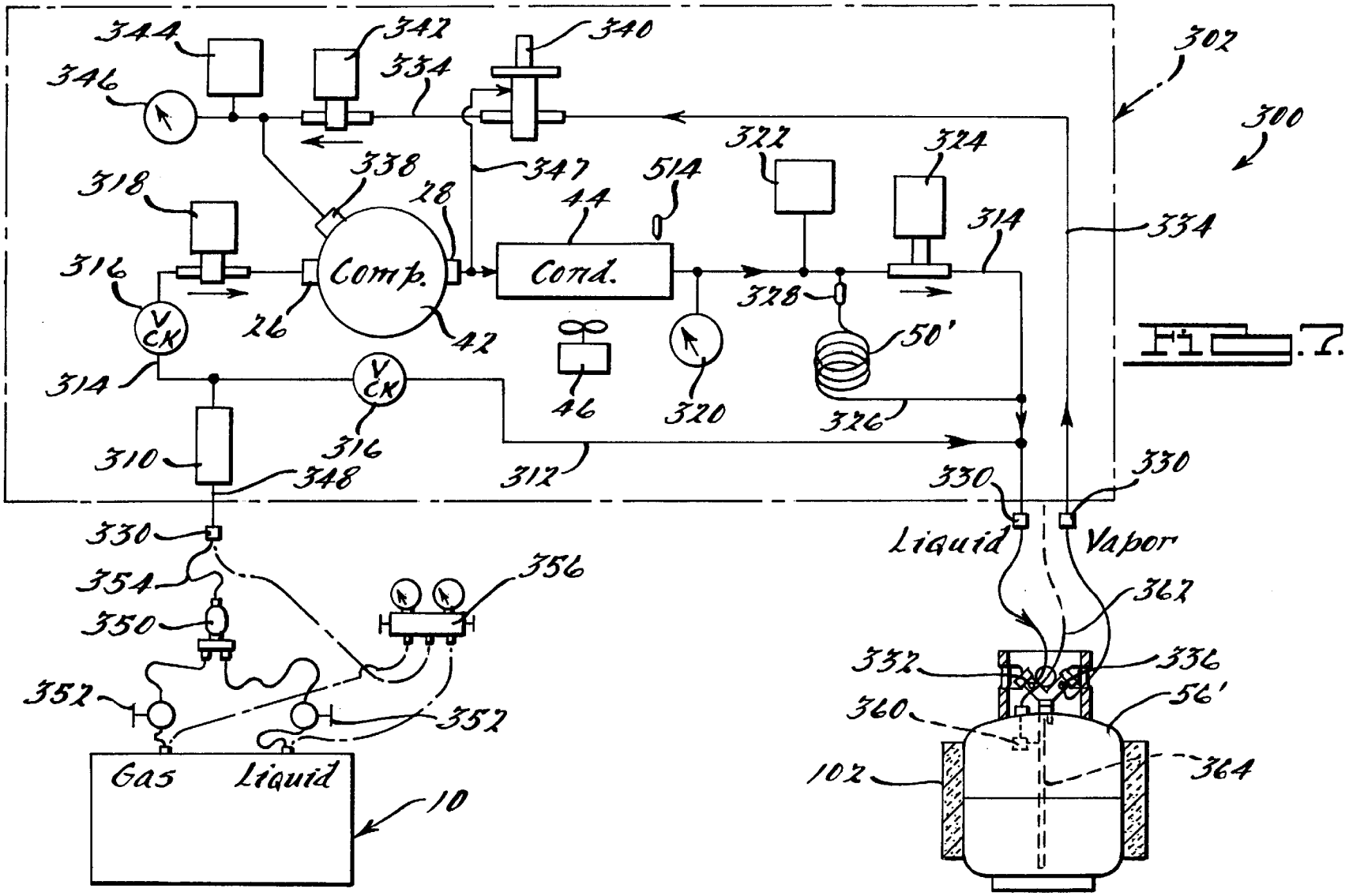
FIG. 7 is a fluid circuit diagram of the present invention which is an improvement to the FIG. 6 alternative embodiment.
Figure 5:
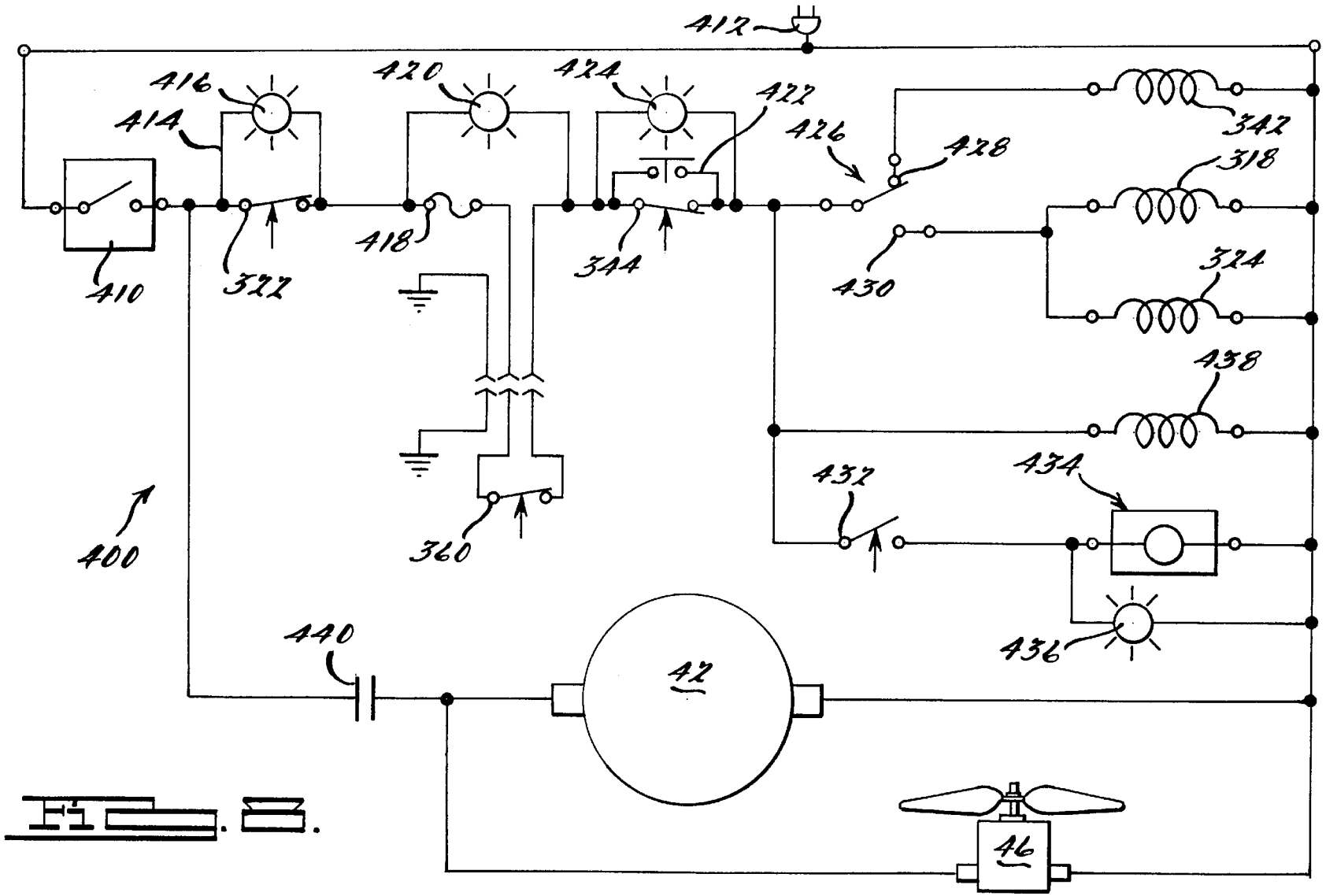

FIG. 7 illustrates an alternative refrigerant recovery system 300 which is an improvement to the FIG. 6 embodiment.

Similar components are included in the recovery system 300 and therefore, where possible, same reference numerals are used. The key to this system 300 is that it uniquely employs a liquid/vapor sensor unit 310 that works in conjunction with a timer/relay 434 to control refrigerant recovery during phases one and two. It will be appreciated that the present system could be modified to create yet an improved system 500 which includes a timer/relay 512 that employs a thermistor 514 (See FIG. 9) to sense the ambient temperature when the system 500 is operating. Based upon the sensed temperature, the timer sequences the system 500 between phases one and two and adjusts the time period of operation for each phase. Further discussion of system 500 will follow.

The refrigerant recovery system 300 includes a housing or unit 302 (shown schematically) which houses a liquid vapor sensor unit 310 located on the inlet side of conduit 312 which is connected to an insulated refrigerant storage tank 56' having an insulated jacket 102. The liquid vapor sensor unit 310 is capable of sensing the presence, or lack thereof, of liquid refrigerant or gaseous refrigerant as it passes through said unit. An electrical signal is produced according to the sensed condition which results in various solenoid valves to be actuated. A one-way check valve 316 is located within conduit 312 for preventing the backflow of refrigerant.

A second conduit 314 extends between the first conduit 312 and the refrigerant recovery compressor 42 which has an inlet 26 and an outlet port 28. A one-way check valve 316 and an electronically operated solenoid valve 318 are located upstream from the compressor in conduit 314. Located downstream from compressor 42 is a condenser 44, a fan 46 for cooling the condenser's coils, a high pressure gauge 320, a high pressure switch 322, and another electronically operated solenoid valve 324 which is also located in conduit 314. An expansion device 50' is located in a bypass 326 as well as a strainer 328 for collecting impurities. The first conduit 312 and second conduit 314 are together connected and a releasable disconnect 330 connects them to the inlet side 332 of the storage tank 56'.

A third conduit 334 is connected between the outlet port 336 of the storage tank and the second inlet port 338 of the compressor 42. This third conduit 334 includes an external pressure sensing compressor pressure regulator valve (CPR) 340, an electronically operated solenoid valve 342 for controlling the flow of fluid in conduit 334, a low pressure switch 344 which senses the pressure in the system 10 being evacuated and a low pressure gauge 346 which provides the operator with performance characteristics of the refrigeration system 300. A quick disconnect 330 and assorted piping connects the outlet port 336 of the storage tank 56' to the conduit 334. The CPR valve 340 is unique in that it continuously senses the compressor discharge pressure via conduit 347 during the phase one mode of operation. As long as the compressor discharge pressure is below, for example, 300 PSIG, the CPR valve 340 remains inactive. However, once a compressor discharge pressure of preferably 300–350 PSIG is sensed, the CPR valve 340 begins to throttle the suction pressure in order to control and maintain a maximum compressor discharge pressure. Further, the high pressure switch 322 is set at a higher pressure, preferably 395 PSIG, where it will then trip thus causing the compressor 42 to be de-energized.

The refrigerant recovery system 300 also includes an inlet segment 348 that is connected by a conventional connector 330 to the field unit 10 that is being serviced. An inlet filter 350 and manual ball valves 352 are located within a conduit 354 that extends between connector 330 and the field unit 10. The filter 350 operates to collect certain impurities prior to entering the housing recovery unit 302 of the system 300. Also, a set of analog gauges 356 may be provided to give data feedback to the operator while the refrigerant is being recovered.

With continued reference to FIG. 7, disposed within the storage tank 56', is a magnetic float switch 360 that is connected to an external float switch cable 362. A dip tube 364 is also positioned within the tank 56' The cable 362 must be connected to the housing 302 prior to operating the system 300. The float switch 360 operates in a normally closed position and when the storage tank 56' reaches a predetermined level, the float switch 360 opens which causes the compressor 42 to shut off. It is preferred that the float 360 deactivate the compressor 42 once the storage tank 56' reaches a capacity level of 80%.

FIG. 8 represents the electrical circuitry 400 of the present invention. Here a manually operated single-pole-single-throw power switch 410 is connected to an outlet by way of plug 412. The electrical circuit 400 also includes a normally closed single-pole-single-throw normally closed high pressure switch 322 and a by-pass circuit 414 around the high pressure switch 322. A high pressure light indicator 416 is located in the by-pass 414 and is operable to inform the operator that the high pressure switch 322 is open. This preferably occurs at a pressure level of 395 PSIG. The electrical circuit 400 also includes the magnetic float switch 360 which is in series with the high pressure switch 322. The float switch 360 is a spring biased single-pole-single-throw type switch that is slideably positioned within a brass tube. As long as a predetermined level, preferably less than 80% tank volume, is maintained within the storage tank 56', the float switch 360 maintains its normally closed position. This is because the magnetized contacts of the switch 360 keep the switch closed as long as it is energized. But when it is de-energized, the spring force opens the switch 360. This arrangement maintains electrical continuity to the compressor 42. A fuse 418 is in series with a float switch 360 which are in parallel with a tank full capacity indicator 420 which is located in a by-pass circuit around the fuse 418 and the float switch 360. Because the float switch is located within the tank 56', the cable 362 electrically connects with the switch 360 to the refrigerant recovery housing 302.

A spring biased single-pole-single-throw low pressure switch 344 is maintained in a normally closed position during refrigerant recovery. However, once the vacuum level within the field unit 10 reaches a predetermined level, for example 15 inches of mercury plus or minus 3 inches of mercury, the low pressure switch 344 will open thus breaking continuity within the circuit 400. This causes the compressor 42 to shut down because relay 438 is deenergized. An indicator light 424 is located in a by-pass circuit to inform the operator that recovery of refrigerant is complete. Once this indicator is energized, the operator can disconnect the field unit 10 and the storage tank 56' from the refrigerant recovery unit 302. A reset button 422 is connected in parallel with the low pressure switch 344 for resetting the system 300 if the recovery complete light 424 is still illuminated once the power switch 410 is activated. It is preferred that button 422 be depressed until low pressure gage 346 reads approximately 5 PSIG. This is needed because the contacts of switch 344 may have been left open after the last recovery cycle was completed.

The refrigerant recovery circuit 400 of the present invention also includes a single-pole-double-throw switch 426 which has a first pole 428 for liquid/vapor recovery (phase one), and a second pole 430 for strictly vapor recovery (phase two). Switch 426 is a part of the circuit board of relay 434 where the first pole 428 is the normally closed position and the second pole 430 is the open position. During phase one, the first solenoid valve 342 is automatically energized. However, during the second phase of recovery, switch 424 is thrown to the second pole 430 position thereby energizing the second solenoid valve 318 and the third solenoid valve 324. Thus, switch 426 operatively activates the two phases of operation which are important to the present invention.

The electrical circuit 400 also includes a liquid/vapor sensor unit 310 which is comprised of a normally open spring biased single-pole-single-throw magnetic electrical switch 432. The switch 432 is in its open position during the phase one refrigerant recovery mode which causes an electrical timer/relay 434 to be de-energized thus maintaining switch 426 in the position shown which is the liquid/vapor recovery mode of operation. However, once the liquid/vapor sensor unit 310 senses the lack of liquid refrigerant being passed therethrough, switch 432 closes which causes vapor recovery indicator 436 to be energized along with the timer/relay 434. The timer allows for an additional time period, approximately 90 seconds, to pass thus allowing the refrigerant recovery system 300 to continue in the phase one mode of operation. This assists in making certain that all of the liquid refrigerant has been recovered as well as provides additional cooling to the tank.

Once the predetermined time period has lapsed, an electrical signal is sent to switch 426 thus automatically causing switch 426 to be thrown to the second pole position 430. This causes solenoid valves 318 and 324 to be energized or opened while solenoid valve 342 is de-energized (closed), thus discontinuing the flow of refrigerant through conduit 334 and initiating flow in conduit 314. The timer/relay 434 produces this delay by using built-in circuit logic which includes a timer mechanism for delaying the electrical output which in turn, delays the throwing of the switch 426 to the second pole 430 position which is the vapor recovery mode of operation. It will be appreciated that the timer 434 could be programmable and/or ambient condition sensitive in order to control one or more phases of operation.

As long as the power switch 410 is on, and as long as switches 322, 344 and 360 are maintained in their normally closed positions, electrical relay 438 will be energized thus closing contact 440 which provides electrical continuity to the compressor 42 and to the fan 46. Thus, the refrigerant recovery system 300 will continue to recover refrigerant, in either phase one, or phase two, until a predetermined condition is reached. This predetermined condition could be either the high pressure switch 322 opening which preferably occurs at around 395 PSIG, the float switch 360 producing a signal that is indicative of the refrigerant recovery tank 56' reaching an 80% capacity level, or the low pressure switch 344 sensing a field unit 10 pressure level of approximately 15 inches of mercury ±3 inches of mercury.

The operation of the present invention is unique in that it employs two separate phases, or modes, of operation that are initially controlled by the liquid/vapor sensor unit 310. The first step requires operator to connect the appropriate fluid conduits to the field unit 10 and to the storage tank 56', and then to connect the float switch cable 362 to the tank 56'. Next the operator should make certain that the recovery system 300 is purged from noncondensables or other refrigerants prior to beginning refrigerant recovery. Thereafter the pressure in the tank 56' needs to be reduced, preferably by a vacuum pump (not shown), to a preferred level of 200 microns of mercury in order to assist in fluid recovery. This is to make certain that the system and tank are cleansed and ready for use. The system 300 is now ready to begin refrigerant recovery by depressing power switch 410 which causes gas and liquid refrigerant to be drawn through valves 352 and through the filter 350 where particulate is accumulated therein. However, if the light 424 is initially illuminated, then the operator must depress reset button 422 for a predetermined time period. Preferably long enough to allow the pressure in the system to reach a pressure level to close (or reset) low pressure switch 344. Generally 5 PSIG will be sufficient.

The system 300 now begins recovery which causes refrigerant to advance through the liquid/vapor sensor unit 310 where the status or type of refrigerant, i.e., liquid or gaseous refrigerant is sensed. The system 300 is designed such that liquid refrigerant is initially recovered during the start-up phase of operation which causes a signal indicative of a liquid refrigerant to be produced by the liquid/vapor sensor unit 310. This causes switch 432 to maintain its normally open position. Because sensor timer/relay 434 is not yet energized, switch 426 is positioned as shown which consequently energizes the first solenoid valve 342. Meanwhile, second solenoid valve 318 and third solenoid valve 324 are closed because they are not energized. This creates a refrigerant fluid path through conduit 312 to the inlet 332 of the storage tank 56'. At the same time, gaseous refrigerant is withdrawn from the storage 56' through conduit 334, CPR valve 340, through the first solenoid valve 342, and then to the second inlet 338 of the compressor 42. The pressure in conduit 334 is continuously monitored by low pressure switch 344 and gauge 346 provides the operator with a readout. The withdrawn refrigerant is then compressed to create hot compressed gas, the hot compressed gas is condensed by condenser 44, and the resulting condensed liquid is directed through by-pass 326 through a strainer 328, and an expansion device 50', where it is returned as a cooled liquid to the inlet 332 of the storage tank 56'. Thus, during the liquid recovery phase, a mixture of gaseous and liquid refrigerant is drawn into the storage tank, while the refrigerant recovery unit 300 operates in a cooling-mode in order to cool the storage tank 56' to lower temperatures and pressures.

Phase one recovery continues until liquid refrigerant is no longer sensed by sensor unit 310. Once this occurs, switch 432 closes which in turn energizes the vapor recovery indicator 436 and the timer/relay 434. The timer 434 allows the phase one mode of operation to continue for preferably an additional 90 seconds in order to make certain that all liquid refrigerant is recovered. Thereafter, the timer/relay 434 produces a delayed electrical signal which energizes switch 426. Meanwhile, relay 438 continues to be energized which maintains contact 440 in a closed position and energizes the compressor 42 and the fan 46. Once relay switch 426 is energized, it is thrown into its second position 430, thus energizing solenoid valve 318 and solenoid valve 324 and closing solenoid valve 342. By re-sequencing these valves, the recovered refrigerant is rerouted for a pump-down, or vapor recovery phase of operation which is also known as phase two.

Once in phase two, the refrigerant recovery system 300 is primarily time-based controlled. That is, the timer/relay 434 allows a phase two mode of operation to continue for, preferably, an additional 90 seconds. During this time period, gaseous refrigerant is withdrawn from the field unit 10, through the liquid/vapor sensor unit 310, through the second conduit 314, and to the compressor 42 where lower temperature compressed gas is created. The lower temperature compressed gas is passed through the condenser 44, through a solenoid valve 324, and is directed via conduit 314 to the inlet 332 of the tank 56'. This pump-down phase causes a build-up of pressure and temperature within the storage tank 56'. This condition is accommodated by reverting to the phase one mode of operation, as previously discussed above, which subsequently reduces the pressure and temperature within the storage tank to an acceptable level. The refrigerant recovery system 300 continues to operate in phase one for an additional 90 seconds. Switching between the phases will continue thereafter at the predetermined time periods until one of a number of predetermined conditions are satisfied. For example, if the high pressure switch 322 senses a condensed pressure of approximately 395 PSIG, then high pressure indicator 416 will illuminate and the continuity in electrical circuit 400 will be broken. This causes compressor 42 to be de-energized. Also, if the float switch 360 senses a storage tank 56' volume fill level of 80% or more, then the contact of switch 360 will open thus causing relay 438 to de-energize thus opening contact 440 which disconnects compressor 42. Finally, when low pressure switch 344 senses a pressure in the field unit 10 of 15 inches of mercury ±3 inches of mercury, switch 344 will then open thus de-energizing compressor 42. An indicator 424 will also illuminate in order to inform the operator that recovery is complete.

Figure 9:
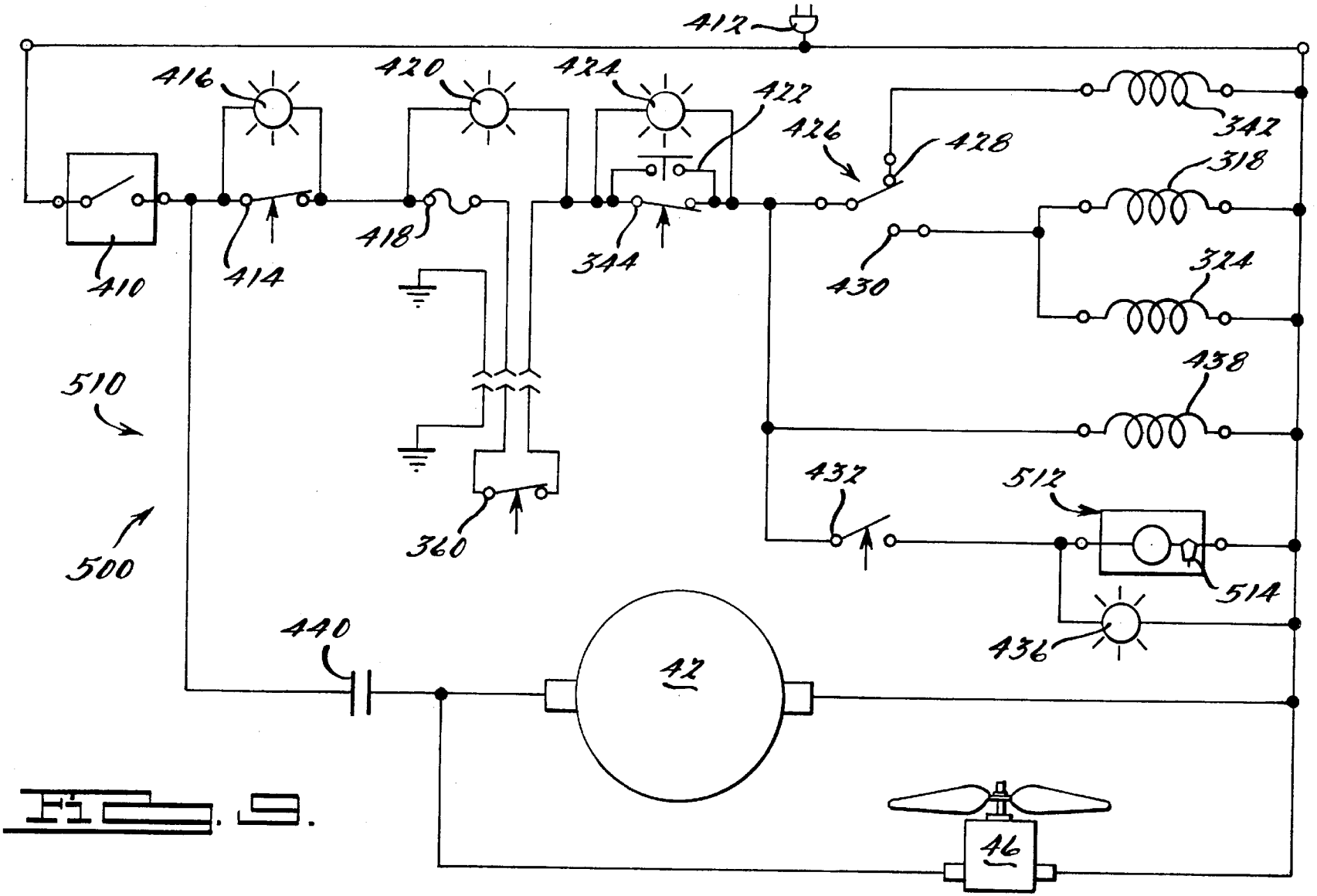
FIG. 9 is an electronic circuit diagram of an alternative embodiment which employs a thermistor for sensing ambient temperature.

FIG. 9 refers to yet another refrigeration recovery system 500 hiving an improvement which includes an ambient temperature responsive electrical circuit 510. Where possible, like reference numerals have been used. The alternative system 500 is similar to the previously discussed refrigeration system 300. However, as seen in FIG. 9, an improved timer/relay 512 is used which employs a thermistor 514 that is electrically connected to the timer 512. The sensing portion (see FIG. 7) of the thermistor 514 is preferably located near the coils of the condenser 44 in order to sense the ambient temperature. A signal is produced by the sensor and is electrically transmitted to the timer 512 which processes the signal. Thus, a signal indicative of the sensed ambient temperature is produced and electronically relayed to timer/relay 512. The circuit logic of timer/relay 512 processes the signal in order to calculate a time period for operating the two different modes of operation. For example, if an ambient temperature of approximately 120° F. is sensed, then a signal would be produced indicative of a time period for delay of greater than 90 seconds. This of course would cause the phase one mode of operation to continue for a longer time period than the previously discussed system 300. Moreover, if the thermistor 514 produces a signal of a low ambient temperature, for example 50° F., then the timer/relay 512 would delay for a time period less than the standard 90 seconds which would cause the phase one mode of operation to be shorter. Accordingly, this combination of thermistor 514 and timer/relay 512 allows the refrigerant recovery system 500 to be ambient temperature sensitive which will optimize the time period for operating in phases one and phases two. The remaining components and method of operation of system 500 are the same as that previously discussed with respect to system 300.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A refrigerant recovery system comprising:

a recovery compressor having a suction side and a discharge side;

a condenser connected to said compressor;

an insulated recovery tank for storing recovered refrigerant;

a controller connected to said system for automatically operating said system in a liquid recovery phase when the recovered refrigerant is liquid and a vapor recovery phase when the recovered refrigerant is a vapor;

a timer connected to the controller to maintain the refrigerant recovery system in the liquid recovery phase for an additional time period after the recovered refrigerant is no longer a liquid, and before the vapor recovery phase is activated; and a sensor for measuring ambient temperature, the sensor electrically connected to the timer for operating the recovery system in the liquid recovery phase for a period of time that is proportional to the ambient temperature.

2. The refrigerant recovery system according to claim 1, wherein said controller includes a liquid/vapor sensor, connected upstream from said recovery tank, for sensing the presence of liquid refrigerant as it enters said recovery system.

3. The refrigerant recovery system according to claim 1, said system further comprising a recovery tank capacity fill sensor which is operable to produce a signal indicative of the recovery tank having a predetermined level.

4. The refrigerant recovery system according to claim 1, said system further comprising a throttling device located between the tank and the compressor for maintaining a discharge pressure of the recovery compressor by restricting the flow of refrigerant to the suction side of the compressor.

5. A device for recovering contaminated refrigerant from a refrigeration system comprising:

a compressor for compressing refrigerant that is delivered thereto, said compressor having an inlet and an outlet;

a storage tank for containing contaminated refrigerant;

a first conduit connected to said refrigeration system and said storage tank;

a fluid sensor located within said first conduit for sensing the presence of liquid and or gaseous refrigerant as it is being recovered from the refrigeration system, said sensor operable to produce an electrical signal indicative of liquid refrigerant being recovered;

a second conduit connected to said first conduit and to said compressor;

a condenser connected to the outlet of said compressor;

an expansion member located between said condenser and said storage tank;

a third conduit between said storage tank and said inlet of said compressor;

a first electrically operated valve located in said third conduit for controlling the flow of refrigerant therein;

a second electrically operated valve located in said second conduit for controlling the flow of refrigerant therein;

a third electrically operated valve located between said condenser and said storage tank for controlling the flow of refrigerant therebetween; and an ambient temperature signal producing member connected to each said valve for controlling the operation of the device.

6. The device according to claim 5, said device further comprising a timing member for activating said device into a pump-down mode of operation.

7. The device according to claim 5, further comprising a timer that is operable to sequence the opening and closing of said valves at predetermined time periods.

8. The device according to claim 5, wherein the ambient temperature signal producing member is a thermistor that senses ambient temperatures and produces a signal that is indicative of the sensed ambient temperature.

9. The device according to claim 5, further comprising a storage tank float switch that is operable to produce a signal indicative of the storage tank being at capacity.

10. The device according to claim 5, further comprising an external pressure sensing regulator that is in communication with said compressor inlet and outlet and is operable to maintain a maximum compressor discharge pressure.

11. The device according to claim 5, wherein said fluid sensor produces a signal that is indicative of all liquid refrigerant having been recovered, said signal is relayed to a timer relay that delays the activation of a vapor recovery mode of operation.

12. An automatic refrigerant recovery system having a refrigerant tank volume fill sensor member, said system comprising:

a recovery compressor powered by an electrical power source;

a refrigerant storage tank for containing recovered refrigerant;

a volume fill sensor member including a float switch contained in said refrigerant storage tank, said switch being normally closed and producing a first signal when said tank is less than approximately 80% filled in volume with recovered refrigerant, said switch opening and producing a second signal when said tank is approximately 80% filled in volume with recovered refrigerant;

an electrical circuit including said float switch and a relay that is normally closed which causes an electrical connection between said recovery compressor and said power source;

a timer connected to said electrical circuit for delaying the activation of a vapor recovery mode of operation; and a temperature sensor that produces signals indicative of the ambient temperature, the sensor connected to the timer to control activation of the vapor recovery mode of operation.

13. The recovery system according to claim 12, wherein said electrical circuit further includes a storage tank full capacity indicator that is activated when said second signal is detected.

14. The recovery system according to claim 12, further comprising a fluid sensor that is external to the storage tank that senses the presence of liquid refrigerant being recovered from a separate refrigeration system.

15. A refrigerant recovery system comprising:

a recovery compressor having a suction side and a discharge side;

a condenser connected to said compressor;

an insulated recovery tank for storing recovered refrigerant;

a liquid vapor control unit producing a first signal for operating said recovery system in a first phase a liquid recovery and for producing a second signal for operating said recovery system in a second phase of vapor recovery;

an external pressure regulating device located between the recovery tank and the suction side of the compressor for maintaining the discharge pressure of the compressor by restricting the flow of refrigerant to the suction side of the compressor;

a delay device connected to the liquid vapor control unit for a delay period that is sufficient to ensure that there is insufficient liquid being recovered by the recovery system so as to not damage the compressor; and a sensor for measuring ambient temperature, the sensor electrically connected to the delay device for operating the recovery system in the first phase for a time period that tis proportional to the ambient temperature.

16. A refrigerant recovery system comprising:

a recovery compressor having a suction side and a discharge side;

a condenser connected to said compressor;

an insulated recovery tank for storing recovered refrigerant;

a controller operable to produce a signal indicative of liquid refrigerant being recovered in order to maintain a first phase of liquid recovery;

a timer device electrically connected to the controller for initiating a second phase of vapor recovery after the controller no longer produces said signal; and a sensor for measuring ambient temperature, the sensor electrically connected to the timer device for operating the recovery system in the first phase for a time period that is proportional to the ambient temperature.

17. A device for recovering contaminated refrigerant from a refrigeration system comprising:

a compressor for compressing refrigerant that is delivered thereto, said compressor having an inlet and an outlet;

a storage tank for containing contaminated refrigerant;

a first conduit connected to said refrigeration system and said storage tank;

a fluid sensor located within said first conduit for sensing the presence of liquid and or gaseous refrigerant as it is being recovered from the refrigeration system;

a second conduit connected to said first conduit and to said compressor;

a condenser connected to the outlet of said compressor;

an expansion member located between said condenser and said storage tank;

a third conduit between said storage tank and said inlet of said compressor;

a first electrically operated valve located in said third conduit for controlling the flow of refrigerant therein;

a second electrically operated valve located in said second conduit for controlling the flow of refrigerant therein;

a third electrically operated valve located between said condenser and said storage tank for controlling the flow of refrigerant therebetween;

a timing member for activating said device into a pump-down mode of operation; and a thermistor that senses ambient temperatures and produces a signal that is indicative of the sensed ambient temperature, said thermistor being electrically connected to said timing member to control said valves.

18. The device according to claim 16, wherein said fluid sensor produces a signal that is indicative of all liquid refrigerant having been recovered, said signal being relayed to said timing member for delaying the activation of the pump-down mode of operation.

19. An automatic refrigerant recovery system having a refrigerant tank volume fill sensor member, said system comprising:

a recovery compressor powered by an electrical power source;

a refrigerant storage tank for containing recovered refrigerant;

a volume fill sensor member including a float switch contained in said refrigerant storage tank, said switch being normally closed and producing a first signal when said tank is less than approximately 80% filled in volume with recovered refrigerant, said switch opening and producing a second signal when said tank is approximately 80% filled in volume with recovered refrigerant;

an electrical circuit including said float switch and a relay that is normally closed which causes an electrical connection between said recovery compressor and said power source;

a fluid sensor that is external to the storage tank for sensing the presence of liquid refrigerant recovered by the automatic refrigerant recovery system; and a temperature sensor located within the electrical circuit, the sensor being operable to produce a third signal indicative of the ambient temperature for controlling the performance of the recovery system.

20. The automatic refrigerant recovery system according to claim 19, wherein said fluid sensor produces a fourth signal that is indicative of all liquid refrigerant having been recovered, said fourth signal is relayed to a timer relay that delays the activation of a vapor recovery mode of operation.

21. The automatic refrigerant recovery system according to claim 19, further comprising insulation means positioned around the tank.

22. The automatic refrigerant recovery system as claimed in claim 19, wherein said timer is programmable.

23. The system as claimed in claim 15, wherein the delay period is more than sixty seconds.

* * * * *

UNITED STATES PATENT AND TRADEMARK OFFICE

CERTIFICATE OF CORRECTION

PATENT NO. : 5,875,638

DATED : March 2, 1999

INVENTOR(S) : Theodore E. Tinsler

It is certified that error appears in the above-identified patent and that said Letters Patent is hereby corrected as shown below:

Column 1, line 26, ";" should be -- , --.

Column 10, line 59, "1 08" should be -- 108 --.

Column 11, line 26, "recover" should be -- recovery --.

Column 11, line 43, delete "the" (second occurrence).

Column 14, line 9, after "56" insert -- . --.

Column 20, line 13, "tis" should be -- is --.

Column 22, line 16, delete "19" insert -- 12 --.

Signed and Sealed this

Seventh Day of March, 2000

*Attest:*

*Attesting Officer*

Q. TODD DICKINSON

*Commissioner of Patents and Trademarks*